US005894097A

United States Patent [19]

Barry

[11] Patent Number: 5,894,097

[45] Date of Patent: Apr. 13, 1999

[54] PICK FOR STRINGED MUSICAL INSTRUMENTS

[76] Inventor: Kenneth J. Barry, 3614 Harrison, Kansas City, Mo. 64109

[21] Appl. No.: 08/826,154

[22] Filed: Mar. 27, 1997

[51] Int. Cl.[6] ..... G10D 3/00

[52] U.S. Cl. ..... 84/322; D17/20

[58] Field of Search ..... 84/322; D17/20

[56] References Cited

U.S. PATENT DOCUMENTS

| | | | |
|---|---|---|---|
| 1,184,561 | 5/1916 | Napoletano . | |
| 1,254,577 | 1/1918 | Carpenter et al. . | |
| 1,263,740 | 4/1918 | Burdwise . | |
| 1,547,560 | 7/1925 | Burdwise . | |
| 1,573,912 | 2/1926 | Burdwise . | |
| 4,015,502 | 4/1977 | Strong . | |
| 4,248,128 | 2/1981 | Des Gaines | 84/322 |
| 4,497,237 | 2/1985 | Beall | 84/322 |
| 4,879,940 | 11/1989 | Pereira | 84/322 |
| 4,993,302 | 2/1991 | Jonathan . | |

*Primary Examiner*—Cassandra C. Spyrou
*Attorney, Agent, or Firm*—Hovey, Williams, Timmons & Collins

[57] ABSTRACT

A pick (10) for use with a stringed musical instrument is disclosed. The pick includes a generally flat body (12) formed of flexible elastomeric material that is adapted to be held between a player's thumb and index finger and a length of metal wire (14) partially embedded in the body. The ends of the metal wire are twisted and embedded in the body to anchor the wire. A mid-portion of the wire extends outwardly from the body to form a string-engaging pick portion having a rounded, polished tip (36) for picking the strings of the musical instrument.

7 Claims, 3 Drawing Sheets

PICK FOR STRINGED MUSICAL INSTRUMENTS

BACKGROUND OF THE INVENTION

1. Field of the Invention

The present invention relates to picks for stringed musical instruments. More particularly, the invention relates to a pick that combines the advantages of plastic and metal picks and that provides improved playing qualities not found in plastic or metal picks.

2. Description of the Prior Art

Conventional picks for use with stringed instruments such as guitars are typically formed of either hardened plastic materials, such as nylon or celluloid, or metal. Plastic picks are typically easier to grip than metal picks and therefore more comfortable to use. However, plastic picks are not as rigid as metal picks and therefore do not provide the same sound quality as metal picks.

Metal picks are more rigid and therefore provide superior sound quality, especially when used with instruments having metal strings. However, metal picks are uncomfortable to grip, especially when used for long periods of time. Moreover, the flat metal edges of metal picks often prematurely wear out the strings of an instrument.

OBJECTS AND SUMMARY OF THE INVENTION

In view of the foregoing, it is an object of the present invention to provide an improved pick for use with musical instruments.

It is a more particular object of the present invention to provide a pick that combines the advantages of both plastic and metal picks.

Still more particularly, it is an object of the present invention to provide a pick that produces the superior sound quality of a metal pick, that does not prematurely wear out the strings of an instrument, and that is easy and comfortable to grip.

The present invention achieves these objects and other objects that become evident from the description of the preferred embodiments of the invention herein by providing a pick that includes a generally flat body adapted to be held between a player's thumb and index finger and an elongated rigid element having a portion embedded and anchored in the body and a portion extending outwardly from the body for use in picking the strings of an instrument.

The body is preferably formed of flexible, transparent elastomeric material and is substantially thicker than prior art picks. The body may be formed in various shapes and sizes to accommodate various preferences.

In preferred forms, the rigid element is a length of metal wire having its ends embedded in the body to anchor the wire. The mid-section of the wire extends outwardly from the body to form a string-engaging pick portion having an outermost tip. The wire may be bent into a number of shapes before it is embedded in the body. In one embodiment of the invention, the wire is twisted to more securely anchor the wire in the body and to increase the rigidity of the string-engaging pick portion.

In use, the increased thickness and the elastomeric material of the body improves the player's grip of the pick and provides a shock-absorbing medium that absorbs some of the impact of the string-engaging portion upon the strings of an instrument. The body also conforms to the player's fingers over time and bends and twists about several axes during use to further improve the player's grip of the pick.

The metal string-engaging pick portion provides superior sound quality similar to picks made entirely of metal. However, unlike prior art metal picks, the wire tip of the present invention presents a rounded, polished edge that more readily slides from string to string during use. This reduces the friction between the pick and an instrument's strings and therefore permits the player to more rapidly move the pick from string to string. The use of shaped wire rather than a solid piece of metal also reduces the mass and weight of the pick and therefore permits a musician to play longer with less fatigue.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
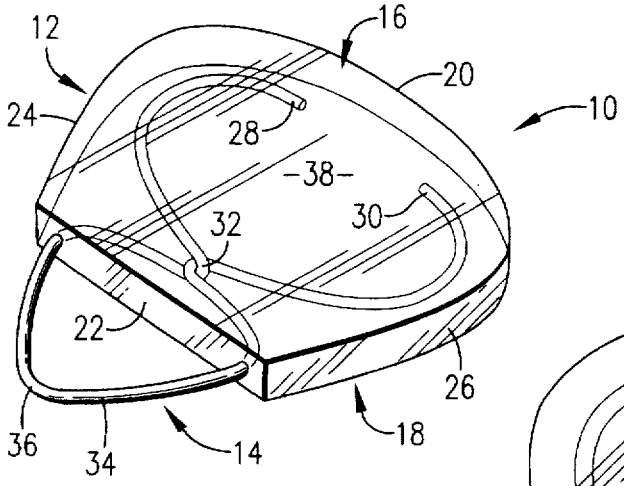
FIG. 1 is a perspective view of a pick constructed in accordance with a first embodiment of the invention.
Figure 2:
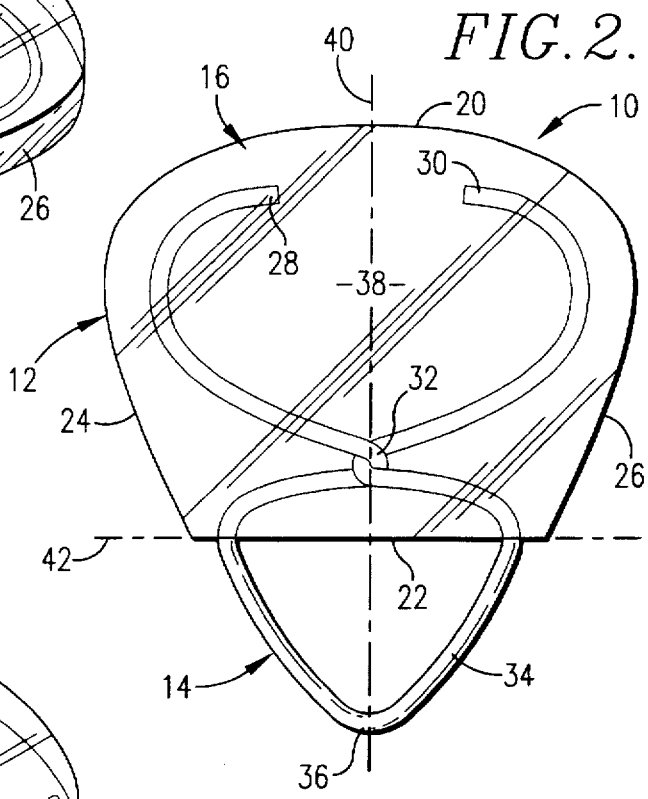
FIG. 2 is a top view of the pick of the FIG. 1 embodiment.

FIGS. 1 and 2 illustrate a pick 10 constructed in accordance with a first, preferred embodiment of the invention. The pick 10 is configured for use with a stringed musical instrument such as a guitar and broadly includes a generally flat body 12 adapted to be held between a player's thumb and index finger and an elongated rigid element 14 partially embedded in the body.

In more detail, the body 12 is preferably formed of flexible, transparent elastomeric material and may be formed in various shapes and sizes to accommodate various preferences. In the illustrated embodiment, the body is generally tear-drop shaped and presents opposed front and rear faces 16,18, an upper edge 20, an opposed truncated lower edge 22, and a pair of opposed curved side edges 24,26. The body is preferably approximately ⅛" thick, which is more than double the thickness of prior art plastic and metal picks.

The rigid element 14 is preferably a length of polished twenty gauge metal wire that is bent before it is embedded in the body. In the first embodiment of the invention, the ends 28,30 of the wire are twisted over one another and then shaped so that the ends diverge immediately above the twist 32 and then converge back towards one another near the top edge 20 of the body. The portion of the wire extending below the twist is formed into a tear drop shaped pick portion 34 that terminates in a rounded string-engaging tip 36.

The ends 28,30 and the twisted portion 32 of the wire are embedded in the body to anchor the wire in the body. The twist 32 is positioned so that it is adjacent the truncated edge 22 of the body. The tear drop shaped pick portion 34 of the wire below the twist extends outwardly from the truncated edge of the body.

The shape of the wire illustrated in FIGS. 1 and 2 provides numerous advantages. For example, the twist 32 and ends 28,30 of the wire securely anchor the wire in the body and increase the rigidity of the string-engaging pick portion 34. Moreover, positioning of the twist 32 near the truncated edge 22 of the body provides maximum structural reinforcement of the pick near the portion of the body that experiences the greatest amount of stress during use of the pick. As illustrated, the portion of the wire that extends outwardly from the body forms a closed loop having a central void.

Additionally, the embedded ends of the wire define a generally enclosed oval region 38 therebetween at the location where a player typically places his or her thumb. Since this region is bounded by wire but has no wire extending through it, it compresses and conforms to a player's thumb over time to further facilitate the gripping of the pick.

A further advantage of the embodiment illustrated in FIGS. 1 and 2 is that the embedded ends 28,30 of the wire form an attractive Taurus or bull's horn shape. Since the body is formed of transparent material, the Taurus shape can be seen even though the wire is embedded in the body.

In use, a musician grips the front 16 and rear 18 faces of the pick 10 between his or her thumb and index finger and then picks the strings of an instrument in a conventional manner. The metal wire 14 provides improved sound quality similar to that achieved in picks made entirely of metal. However, unlike prior art plastic and metal picks, the polished metal tip 36 more readily slides from string to string during use. Specifically, the tip 36 reduces the friction between the pick and the instrument's strings and therefore permits the player to more rapidly move the pick from string to string. The reduced friction between the tip 36 and the strings also reduces the wear on the strings.

The increased thickness and the elastomeric material of the body 12 improves the player's grip of the pick and provides a shock-absorbing medium that absorbs some of the vibration from the strings. Thus, the body 12 does not easily slip from a player's fingers during use as with prior art picks. The body 12 also conforms to the player's thumb and finger over time to further improve the player's grip of the pick. The use of shaped wire rather than a solid metal body also reduces the mass and weight of the pick and therefore permits a musician to play longer with less fatigue.

When the pick 10 is used, it can both twist about a first, central vertical axis 40 depicted in FIG. 2 and bend about a second, horizontal axis 42 due to the flexible nature of the elastomeric body 12. This further enhances the gripping and comfort of the pick.

The pick 10 is preferably manufactured by first bending a length of wire of approximately 8 cm into the desired shape. The shaped wire is then placed in a mold cavity so that its string-engaging pick portion 34 extends outwardly from the mold. A polymeric elastomer or resin is then injected into the mold to form the body of the pick and to embed the wire in the body. The pick is allowed to cool and then removed from the mold cavity.

Figure 3:
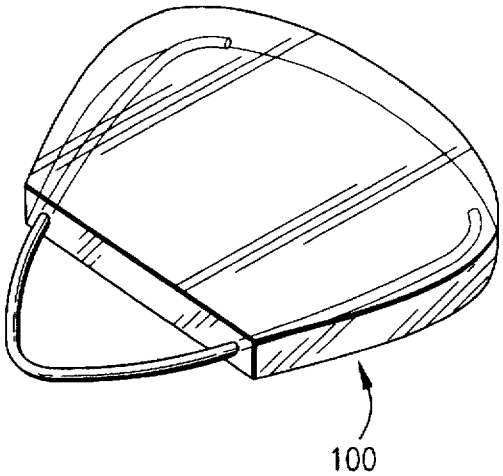
FIG. 3 is a perspective view of a pick constructed in accordance with a second embodiment of the invention.
Figure 4:
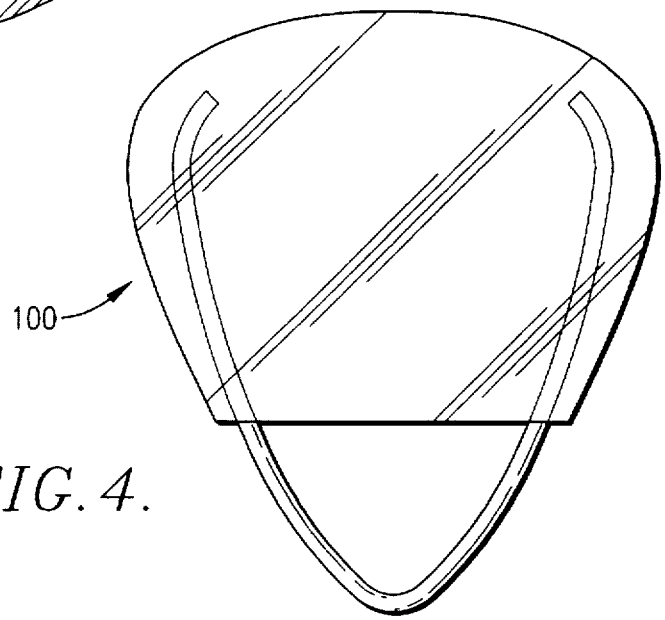
FIG. 4 is a top view of the pick of the FIG. 3 embodiment.

The wire of the pick may be bent into a variety of other shapes before it is embedded in the body to alter the playing characteristics of the pick. For example, FIGS. 3 and 4 illustrate a pick 100 constructed in accordance with a second embodiment of the invention. The pick 100 is substantially identical to the pick 10 of the first embodiment of the invention except that the wire is not twisted.

Figure 5:
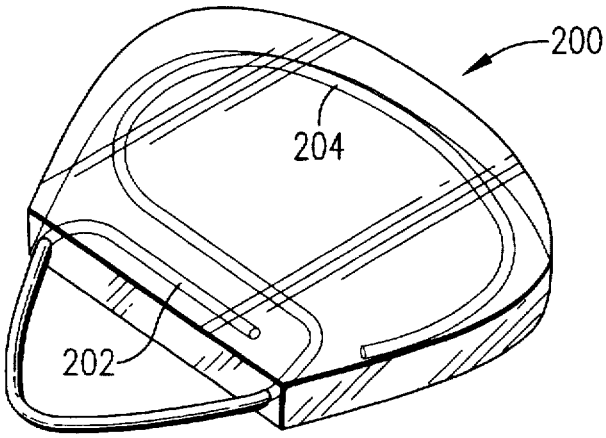
FIG. 5 is a perspective view of a pick constructed in accordance with a third embodiment of the invention.
Figure 6:
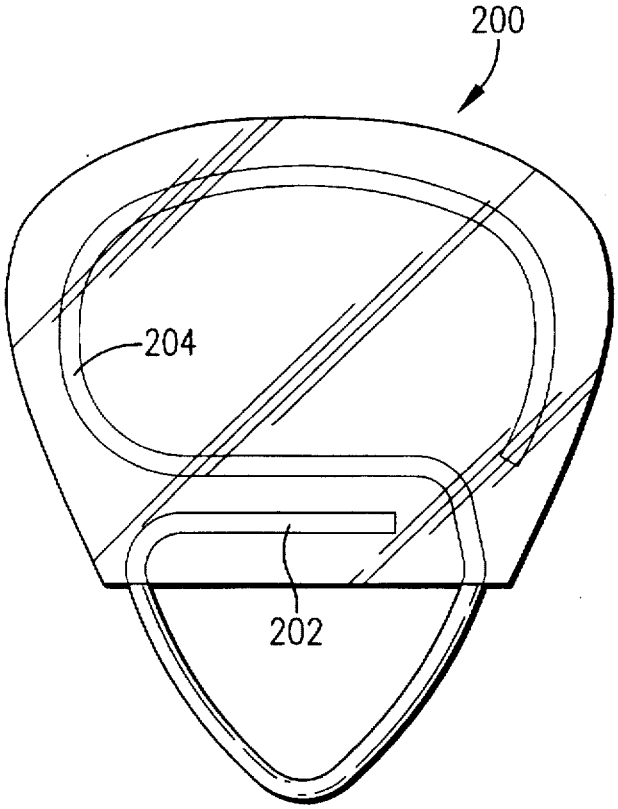
FIG. 6 is a top view of the pick of the FIG. 5 embodiment.

FIGS. 5 and 6 illustrate a pick 200 constructed in accordance with a third embodiment of the invention. The wire of pick 200 has one end 202 that is turned so that it runs adjacent and generally parallel to the truncated edge of the body and another end 204 that is bent into a generally S-configuration.

Figure 7:
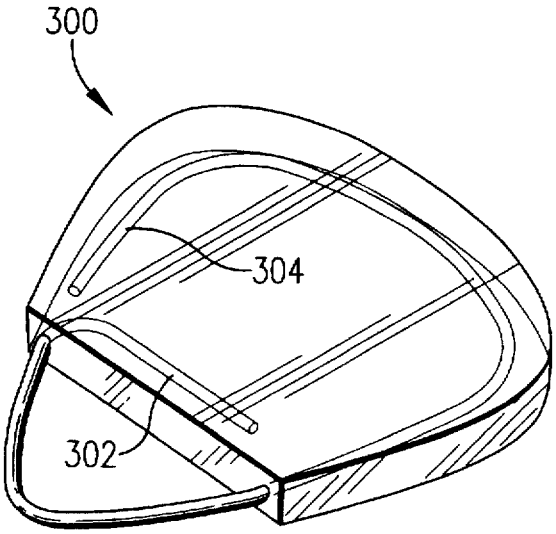
FIG. 7 is a perspective view of a pick constructed in accordance with a fourth embodiment of the invention.
Figure 8:
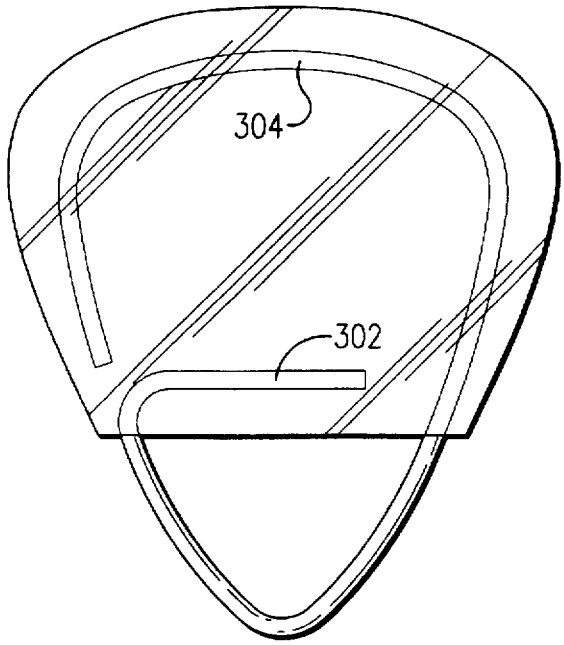
FIG. 8 is a top view of the pick of the FIG. 7 embodiment.

FIGS. 7 and 8 illustrate a pick 300 constructed in accordance with a fourth embodiment of the invention. The wire of the pick 300 has one end 302 that is turned so that it runs adjacent and generally parallel to the truncated edge of the body and another end 304 that enters the body near one end of the truncated edge of the body, runs adjacent the periphery of the curved edges and top edge of the body, and terminates near the opposite end of the truncated edge.

Figure 9:
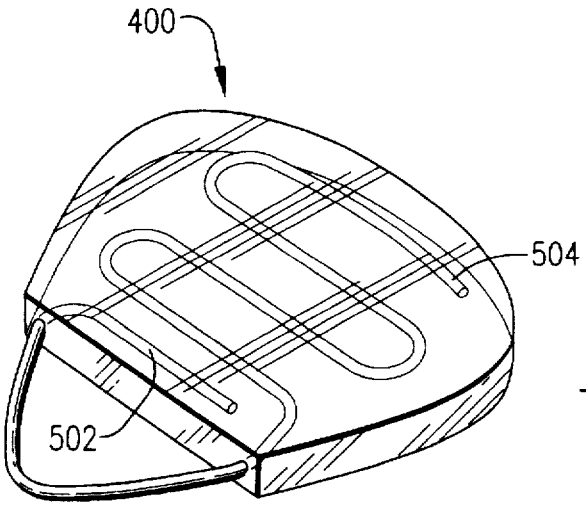
FIG. 9 is a perspective view of a pick constructed in accordance with a fifth embodiment of the invention.
Figure 10:
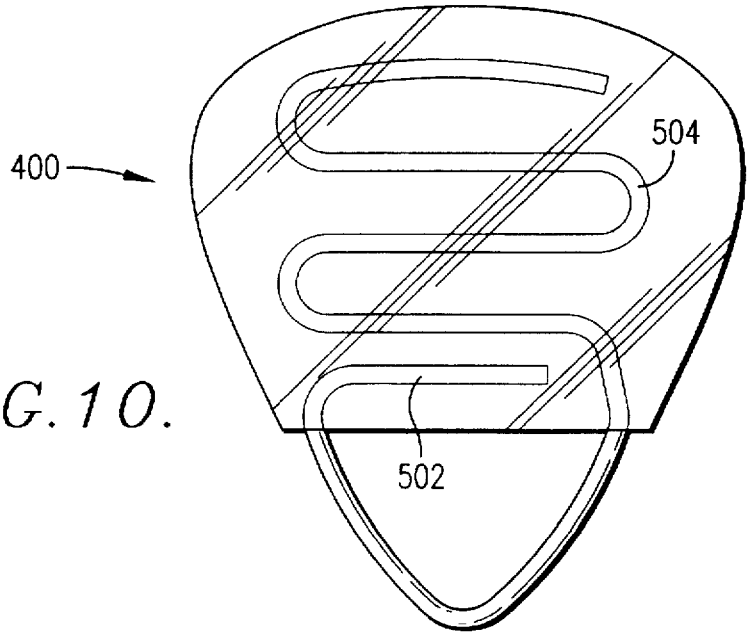
FIG. 10 is a top view of the pick of the FIG. 9 embodiment.

FIGS. 9 and 10 illustrate a pick 400 constructed in accordance with a fifth embodiment of the invention. The wire of the pick 500 has one end 502 that is turned so that it runs adjacent and generally parallel to the truncated edge of the body and another end 504 that enters the body near one end of the truncated edge and that is bent into a generally serpentine pattern.

Although the invention has been described with reference to the preferred embodiment illustrated in the attached drawing figures, it is noted that equivalents may be employed and substitutions made herein without departing from the scope of the invention as recited in the claims. For example, the wire portion of the pick may be bent into any desired shape and still fall within the scope of the present invention.

Having thus described the preferred embodiment of the invention, what is claimed as new and desired to be protected by Letters Patent includes the following:

1. A pick for use with a stringed musical instrument comprising:

a generally flat body adapted to be held between a player's thumb and index finger; and an elongated rigid element including an anchor portion embedded in said body and pick means extending outwardly from said body and forming a close loop having a central void with said body for picking the strings of the musical instrument.

2. The pick as set forth in claim 1, said rigid element comprising a length of metal wire.

3. The pick as set forth in claim 1, said body being formed of flexible elastomeric material.

4. A pick for use with a stringed musical instrument comprising:

a generally flat body adapted to be held between a player's thumb and index finger; and an elongated rigid element including an anchor portion embedded in said body and a pick portion extending outwardly from said body for use in picking the strings of the musical instrument, wherein said anchor portion is twisted for increasing the rigidity of said pick portion.

5. A pick for use with a stringed musical instrument comprising:

a generally flat body adapted to be held between a player's thumb and index finger; and an elongated rigid element including an anchor portion embedded in said body and a pick portion extending outwardly from said body for use in picking the strings of the musical instrument, wherein said anchor portion is looped in said body for increasing the rigidity of said pick portion.

6. A pick for use with a stringed musical instrument comprising:

a generally flat body adapted to be held between a player's thumb and index finger; and an elongated rigid element including an anchor portion embedded in said body and a pick portion extending outwardly from said body for use in picking the strings of the musical instrument, wherein said anchor portion is arranged in a serpentine pattern in said body for increasing the rigidity of said pick portion.

7. A pick for use with a stringed musical instrument comprising:

a generally flat body formed of flexible elastomeric material and adapted to be held between a player's thumb and index finger; and a length of metal wire having its ends embedded in said body to anchor the wire and a portion of its mid-section extending outwardly from said body for use in picking the strings of the musical instrument, wherein the embedded portion of said wire is twisted for increasing the rigidity of said pick portion.

* * * * *